US007330128B1

(12) United States Patent
Lombardo et al.

(10) Patent No.: US 7,330,128 B1
(45) Date of Patent: Feb. 12, 2008

(54) SYSTEM AND METHOD FOR DETECTING RADIOLOGICAL WASTE BY TRASH COLLECTION VEHICLES

(76) Inventors: Thomas Lombardo, 113 King St., Staten Island, NY (US) 10308; Armando Arzuaga, Jr., 60 Clifton Ave., Staten Is., NY (US) 10305

( * ) Notice: Subject to any disclaimer, the term of this patent is extended or adjusted under 35 U.S.C. 154(b) by 129 days.

(21) Appl. No.: 11/134,783

(22) Filed: May 23, 2005

(51) Int. Cl.
*G08B 23/00* (2006.01)

(52) U.S. Cl. ..... 340/693.5; 340/540; 340/471; 73/23.2; 177/139

(58) Field of Classification Search ..... 340/551, 340/572.2, 471, 540, 693.5; 177/139, 145; 100/92, 211, 226, 229 A, 252; 414/510, 414/517, 406, 408, 407; 73/23.2
See application file for complete search history.

(56) References Cited

U.S. PATENT DOCUMENTS 5,214,594 A 5/1993 Tyler et al. ..... 702/43
5,230,393 A 7/1993 Mezey ..... 177/139
5,412,206 A 5/1995 Seidel et al. ..... 250/253
5,565,846 A 10/1996 Geiszler et al. ..... 340/572.2
5,705,818 A 1/1998 Kelbel et al. ..... 250/361
6,031,454 A 2/2000 Lovejoy et al. ..... 340/539.29
6,708,140 B2 3/2004 Zerwekh et al. ..... 702/188
6,823,714 B2 11/2004 Megerle ..... 73/23.2

*Primary Examiner*—Anh V. La
(74) *Attorney, Agent, or Firm*—LaMorte & Associates

(57) ABSTRACT

A system for detecting radiation that is embodied within a trash collection truck. The trash collection truck has a storage bin for holding compressed trash and a collection bin for temporarily holding newly collected trash. A compaction mechanism is used to move newly collected trash out of said collection bin and into said storage bin. At least one sensor is placed proximate the collection bin for detecting radiation. If radiological waste is placed into the collection bin of the trash collection truck, the sensor detects the presence of the radiological material and activates an alarm indicator. The alarm indicator warns the operators of the trash collection truck that radiological waste is present.

5 Claims, 1 Drawing Sheet

SYSTEM AND METHOD FOR DETECTING RADIOLOGICAL WASTE BY TRASH COLLECTION VEHICLES

BACKGROUND OF THE INVENTION

1. Field of the Invention

The present invention relates to vehicles, such as garbage trucks, that are used to collect residential and commercial waste. More particularly, the present invention relates to vehicles containing sensors for detecting the types of waste being collected.

2. Prior Art Description

Many neighborhoods have periodic trash collection. In certain municipalities, trash collection is provided as a public service. In other municipalities, trash collection is provided by private contractors. Regardless of who provides the trash collection service, the activity of trash collection remains the same. Trash, set in trashcans or dumpsters, is set out in an accessible area for collection. Trash collection trucks periodically travel to a home or business for the purpose of collecting the trash. Once a trash collection truck arrives at the home or business, the trash is either manually or mechanically lifted and dumped into the collection bin of the trash collection truck. As trash is dumped into a trash collection truck, the actual trash is rarely observed. If a trash collection truck has a mechanical collection device, the trash is never touched by a human operator, and is therefore not observed. When trash is manually lifted into a trash collection truck, the trash is typically wrapped in trash bags and again the actual trash cannot be observed.

It is illegal to dispose of many types of waste by placing it in a trashcan for collection. Hazardous waste, such as chemicals, pesticides, paint and the like must be brought to specialized collection centers. Many such collection centers exist due to the prevalence of such products in almost every home. Another type of waste that cannot be simply thrown into a trashcan is radiological waste. However, unlike for common chemicals, there are very few cites that collect radiological waste. Radiological waste must be collected and disposed of following strict federal and state guidelines. It therefore cost a significant sum of money to dispose of radiological waste.

Radiological waste is becoming more and more prevalent in modern society. Radiological waste is produced by hospitals, dentist offices, doctor offices, laboratories, universities and many businesses. Since it is time consuming and costly to dispose of radiological waste in the proper fashion, there exists a great incentive for radiological waste to be thrown away with ordinary trash.

Many types of radiological waste are a danger to all people who are exposed to that waste. Thus, if such radiological waste is simply thrown into the trash, the radiological waste becomes a danger to both trash collectors and to landfill personnel. Furthermore, the radiological waste can contaminate the trash bins, the trash collection truck, landfill equipment as well as the soil and water run-off of the landfill.

In the prior art, various systems exist that are designed to detect particle emissions from radiological waste. Complex detection systems are mainly used by Homeland Security personnel and Customs personnel to prevent the illegal importation and exportation of radiological materials. Similar detection systems are used at nuclear reactor sites to detect if any leak of radioactivity has occurred. Large versions of such detection equipment have been used to scan trucks and other large objects, such as railroad cars and shipping containers. Such detection systems are exemplified by U.S. Pat. No. 6,708,140 to Zerwekh, entitled System And Method For Detecting And Monitoring Noncompliant Interstate Transportation Of Materials and U.S. Pat. No. 5,705,818 to Kelbel, entitled Method And Apparatus or Detecting Radioactive Contamination In Steel Scrap.

Detection systems therefore do exist that a trash collection truck can be driven through. However, if such a system does detect the presence of radiological material, the entire contents of the trash collection truck, the trash collection truck itself and the truck's personnel may already have become contaminated. Furthermore, it may not be possible to determine where and when the radiological waste was collected. The people who placed the radiological waste into the trash, therefore, may never be held responsible.

A need therefore exists for a system that can detect radiological waste at the moment that waste is collected. In this way, the radiological waste can be detected before it contaminates the trash collection truck, its contents and its personnel. This need is met by the present invention as is described and claimed below.

SUMMARY OF THE INVENTION

The present invention is a system for detecting radiation that is embodied within a trash collection truck. The trash collection truck has a storage bin for holding compressed trash and a collection bin for temporarily holding newly collected trash. A compaction mechanism is used to move newly collected trash out of said collection bin and into said storage bin. The compaction mechanism is activated by the operators of the trash collection truck whenever the collection bin becomes full.

At least one sensor is placed proximate the collection bin for detecting radiation. If radiological waste is placed into the collection bin of the trash collection truck, the sensor detects the presence of the radiological material and activates an alarm indicator. The alarm indicator warns the operators of the trash collection truck that radiological waste is present. The truck operators can therefore take the appropriate actions to avoid contamination.

BRIEF DESCRIPTION OF THE DRAWINGS

For a better understanding of the present invention, reference is made to the following description of an exemplary embodiment thereof, considered in conjunction with the accompanying drawing, in which.

DETAILED DESCRIPTION OF THE DRAWINGS

Figure 1:
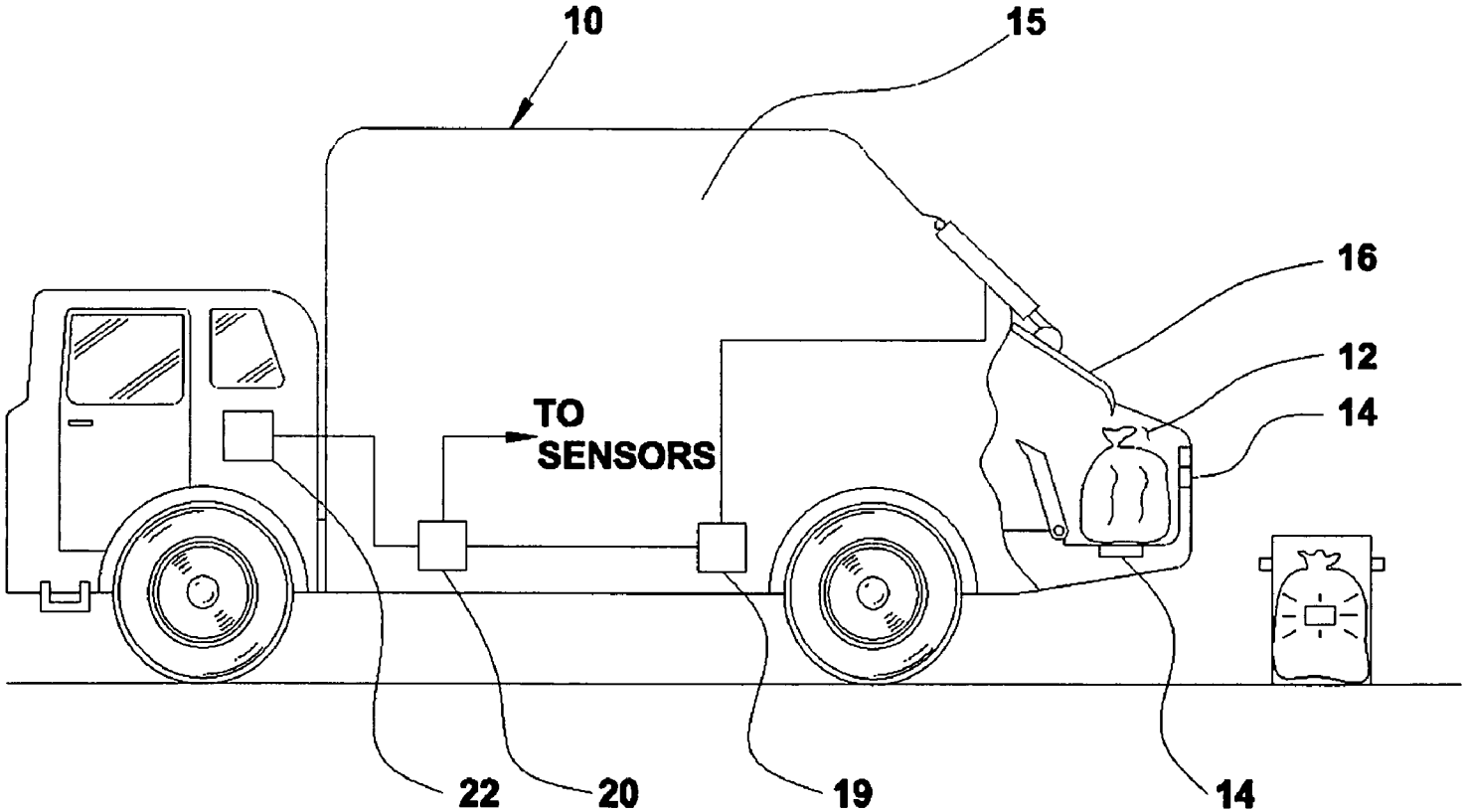
FIG. 1 is a schematic of an exemplary embodiment of a trash collection truck in accordance with the present invention.

There are many types of trash collection trucks that are currently in use. Some trash collection trucks have open collection bins at the rear of the truck. Other types of trash collection trucks have collection bins at the front of the truck, directly behind the drivers cab. Still other trash collection trucks, especially those that lift dumpsters, have collection bins at the top of the truck. Regardless to where trash is placed in the trash collection truck, the newly corrected trash is set into an open collection bin. After all the trash from a particular site has been collected, or when the collection bin is full, a secondary compaction mechanism is used to compress the trash and move the trash deeper into the trash collection truck. This clears the open collection bin so that more trash can be placed into the collection bin.

Referring to FIG. 1, an exemplary trash collection truck 10 is shown. The trash collection truck 10 has an open collection bin 12 for receiving new trash. In the shown embodiment, the trash collection bin 12 is at the rear of the truck 10. It will be understood that the use of such a trash collection truck 10 is merely exemplary and that any of the previously mentioned trash collection trucks can be used in substitute.

The trash collection truck 10 has a large storage bin 15 that is positioned adjacent the collection bin 12. A compaction mechanism 16 is used to periodically compact the trash placed in the collection bin 12 and move that trash into the large storage bin 15. This leaves the collection bin 12 ready to receive more trash. The compaction mechanism 16 is a hydraulic operated system having a hydraulic controller 19. Once activated by an operator of the trash collection truck 10, the hydraulic controller 19 moves the compaction mechanism 16 through a compaction cycle that clears the trash from the collection bin 12.

The trash collection truck 10 is provided with at least one sensor 14 for detecting particle emissions from radiological waste. The sensors 14 are set in close proximity to the collection bin 12. If the sensors 14 are set within the collection bin 12, the sensors 14 are preferably set into the walls of the collection bin 12 so as not to protrude into the trash collection bin 12 and interfere with the compaction mechanism 16 of the trash collection truck 10. The sensors 14 detect radiation emitted by the radiological material. Many such sensors are commercially available and are exemplified by U.S. Pat. No. 6,020,619, to Wada et al., entitled Radioactive Rays Detection Semiconductor Device, the disclosure of which is incorporated into this specification by reference.

Each sensor 14 is attached to a central processor 20. The central processor 20 is also coupled to an alarm indicator 22 and to the hydraulic controller 19 of the compaction mechanism 16. The alarm indicator 22 can be positioned on the trash collection truck 10 at any point close to where the trash collectors stand. However, if the trash collection truck 10 has an automated trash collection system, the alarm indicator 22 can be located within the cab of the truck 10 so that the truck operator can see the alarm indicator 22.

The alarm indicator 22 can be a visual indicator, such as a blinking red light, or an audible indicator, such as a beeper. The preferred embodiment, however, includes both a visual indicator and an audible indicator. In this manner, the truck's operator has the best chance of heeding the alarm indicator 22 once it has been activated.

The sensor 14 constantly senses the area of the collection bin 12 for signs of radioactivity. Background radiation is always present. Also some waste, such as many rocks, emit very low levels of radiation and are not hazardous. If radiation is detected in excess of some predetermined threshold level, then the central processor 20 initiates an alarm condition.

In an alarm condition, the alarm indicator 22 is activated. This informs the truck's operating personnel to the probability of radiological waste being present in the collection bin 12. The central processor 20 also sends a signal to the hydraulic controller 19 that causes the hydraulic controller 19 to automatically stop the compaction mechanism 16. This prevents the compaction mechanism 16 from being accidentally activated once radiological waste has been detected in the collection bin 12.

It is possible that some radiological material can be contained within a sealed container and hidden within a trash bag or box. The sensor 14 may not be able to detect emissions from such radiological material, depending upon the density of the container surrounding the radiological material. However, when the compaction mechanism 16 is activated, the newly added trash becomes crushed. If any radiological material is detected during the compaction cycle, the compaction mechanism 16 is automatically stopped so that the radiological material is not further disrupted.

If the operator of the trash collection truck sees and/or hears the alarm indicator 22, they can immediately take steps to protect themselves. Gloves and outer garments can be removed. Authorities can then be contacted and a decontamination team from local or federal authorities can be dispatched to the location of the trash collection truck. Furthermore, since the radiological material is detected at the point of collection, authorities can more readily determine who is responsible for placing the radiological material into the trash.

It will be understood that the embodiment of the present invention that is described and illustrated herein is merely exemplary and that a person skilled in the art can make many variations to the present invention using functionally equivalent parts. For instance, more than one sensor can be used in a collection bin. Furthermore, sensors can be located at any position that is exposed to the collection bin, including the face of the compaction mechanism. All such variations, modifications and alternate embodiments are intended to be included within the scope of the present invention as set forth by the claims.

What is claimed is:

1. A trash collection truck, comprising:

a storage bin for holding compressed trash;

a collection bin for temporarily holding newly collected trash;

at least one sensor proximate said collection bin for detecting if radiological waste has been placed into said collection bin;

a compaction mechanism for moving the newly collected trash out of said collection bin and into said storage bin, wherein said compaction mechanism is automatically deactivated if radiological waste is detected by said sensor; and an alarm indicator that is activated when said at least one sensor detects radiological waste.

2. The truck according to claim 1, further including a hydraulic controller for operating said compaction mechanism and a central processor coupled to both said at least one sensor and said hydraulic controller, wherein said central processor instructs said hydraulic controller to deactivate said compaction mechanism when said at least one sensor detects radiological material.

3. The truck according to claim 2, wherein said alarm indicator is coupled to said central processor and is activated by said central processor when said at least one sensor detects radiological material.

4. In a trash collection truck having a collection bin and a compaction mechanism for removing trash from said collection bin, a method of determining if radiological material has been placed in said collection bin, said method comprising the steps of:

positioning at least one sensor proximate said collection bin that is capable of detection of radiological waste;

providing an alarm indicator in the trash collection truck;

activating said alarm indicator when said at least one sensor detects that radiological material has been placed within said collection bin; and deactivating said compaction mechanism when said at least one sensor detects that radiological material has been placed within said collection bin.

5. In a trash collection truck having a collection bin for receiving newly collected trash and a compaction mechanism for compacting the newly collected trash, a system for detecting the presence of radiological material within the newly collected trash comprising:

at least one sensor for detecting radiation from radiological materials;

a controller coupled to said at least one sensor for determining if the radiation being detected by said at least one sensor surpasses a predetermined threshold level, wherein said controller controls the compaction mechanism and automatically deactivates the compaction mechanism when said at least one sensor detects radiation above said predetermined threshold level; and an alarm indicator for providing an alarm to operators of the trash collection truck when said at least one sensor detects radiation in excess of said predetermined threshold level.

* * * * *